US007091168B2

(12) United States Patent
Weuthen et al.

(10) Patent No.: US 7,091,168 B2
(45) Date of Patent: Aug. 15, 2006

(54) LIQUID DETERGENTS

(75) Inventors: Manfred Weuthen, Langenfeld (DE); Michael Elsner, Solingen (DE); Ditmar Kischkel, Monheim (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 186 days.

(21) Appl. No.: 09/896,853

(22) Filed: Jun. 29, 2001

(65) Prior Publication Data

US 2002/0107165 A1 Aug. 8, 2002

(30) Foreign Application Priority Data

Jun. 29, 2000 (DE) ..... 100 31 620

(51) Int. Cl.

| | |
|---|---|
| ***C11D 17/08*** | (2006.01) |
| ***C11D 1/02*** | (2006.01) |
| ***C11D 1/722*** | (2006.01) |
| ***C11D 1/83*** | (2006.01) |
| ***C11D 3/37*** | (2006.01) |

(52) U.S. Cl. ..... 510/356; 510/360; 510/421; 510/422; 510/475; 510/505; 510/506; 8/137

(58) Field of Classification Search ..... 510/356, 510/360, 421, 422, 475, 505, 506; 8/137
See application file for complete search history.

(56) References Cited

U.S. PATENT DOCUMENTS

| | | | | |
|---|---|---|---|---|
| 4,524,009 | A | | 6/1985 | Valenty |
| 4,639,325 | A | | 1/1987 | Valenty et al. |
| 4,816,553 | A | | 3/1989 | Baur et al. |
| 4,898,621 | A | * | 2/1990 | Pruehs et al. ..... 134/25.2 |
| 4,985,553 | A | | 1/1991 | Fuertes et al. |
| 5,374,716 | A | | 12/1994 | Biermann et al. |
| 5,494,488 | A | | 2/1996 | Arnoldi et al. |
| 5,501,814 | A | | 3/1996 | Engelskirchen et al. |
| 5,541,316 | A | | 7/1996 | Engelskirchen et al. |
| 5,576,281 | A | * | 11/1996 | Bunch et al. ..... 510/220 |
| 5,576,425 | A | | 11/1996 | Hill et al. |
| 5,580,941 | A | | 12/1996 | Krause et al. |
| 5,766,371 | A | * | 6/1998 | Bunch et al. ..... 134/25.2 |
| 5,821,360 | A | | 10/1998 | Engelskirchen et al. |
| 5,830,956 | A | | 11/1998 | Stockhausen et al. |
| 5,959,101 | A | | 9/1999 | Engelskirchen et al. |
| 6,075,001 | A | | 6/2000 | Wilde |
| 6,153,576 | A | | 11/2000 | Blum et al. |
| 6,187,055 | B1 | | 2/2001 | Kottwitz et al. |
| 6,200,946 | B1 | | 3/2001 | Blum et al. |
| 2002/0107165 | A1 | * | 8/2002 | Weuthen et al. ..... 510/421 |

FOREIGN PATENT DOCUMENTS

| | | | |
|---|---|---|---|
| DE | 42 21 381 | | 2/1994 |
| DE | 44 16 438 | | 11/1995 |
| DE | 44 17 734 | | 11/1995 |
| DE | 43 03 320 | | 12/1995 |
| DE | 44 43 177 | | 6/1996 |
| DE | 195 29 905 | | 2/1997 |
| DE | 43 00 772 | | 3/1997 |
| DE | 195 36 082 | | 4/1997 |
| DE | 196 00 018 | | 7/1997 |
| DE | 196 05 688 | | 8/1997 |
| DE | 196 13 103 | | 10/1997 |
| DE | 196 20 411 | | 10/1997 |
| DE | 196 16 693 | | 11/1997 |
| DE | 196 16 767 | | 11/1997 |
| DE | 196 16 769 | | 11/1997 |
| DE | 196 16 770 | | 11/1997 |
| DE | 196 20 267 | | 11/1997 |
| DE | 19738866 | * | 3/1999 |
| DE | 10017191 | * | 10/2001 |
| EP | 0 150 930 | | 8/1985 |
| EP | 0 232 202 | | 8/1987 |
| EP | 0 272 030 | | 6/1988 |
| EP | 0 280 223 | | 8/1988 |
| EP | 0 301 298 | | 2/1989 |
| EP | 0 392 592 | | 10/1990 |
| EP | 0 427 349 | | 5/1991 |
| EP | 0 458 397 | | 11/1991 |
| EP | 0 458 398 | | 11/1991 |
| EP | 0 472 042 | | 2/1992 |
| EP | 0 525 239 | | 2/1993 |
| EP | 0 542 496 | | 5/1993 |
| EP | 0 544 490 | | 6/1993 |
| EP | 0 544 519 | | 6/1993 |
| EP | 0 549 271 | | 6/1993 |
| EP | 0 549 272 | | 6/1993 |
| EP | 0 446 982 | | 10/1994 |
| EP | 0 453 003 | | 10/1994 |
| EP | 0 443 651 | | 10/1995 |
| EP | 0 693 550 | | 1/1996 |
| EP | 693049 | * | 9/1998 |
| EP | 0 693 049 | | 9/1999 |
| EP | 0 703 292 | | 4/2001 |
| EP | 1167499 | * | 1/2002 |
| JP | 05 339896 | | 12/1993 |
| WO | WO90/03977 | | 4/1990 |
| WO | WO92/18542 | | 10/1992 |
| WO | WO93/08251 | | 4/1993 |
| WO | WO93/16110 | | 8/1993 |
| WO | WO94/22800 | | 10/1994 |
| WO | WO94/27970 | | 12/1994 |
| WO | WO94/28030 | | 12/1994 |
| WO | WO94/28102 | | 12/1994 |
| WO | WO94/28103 | | 12/1994 |
| WO | WO95/00626 | | 1/1995 |
| WO | WO95/07303 | | 3/1995 |
| WO | WO95/12619 | | 5/1995 |
| WO | WO95/14075 | | 5/1995 |
| WO | WO95/14759 | | 6/1995 |
| WO | WO95/17498 | | 6/1995 |
| WO | WO95/20029 | | 7/1995 |
| WO | WO95/20608 | | 8/1995 |
| WO | WO95/27775 | | 10/1995 |
| WO | WO 01/79401 | * | 10/2001 |

* cited by examiner

OTHER PUBLICATIONS

Derwent Patent Abstract for DE 19738866 (Schmid et al), published Mar. 11, 1999.*

*Primary Examiner*—Brian P Mruk
(74) *Attorney, Agent, or Firm*—John F. Daniels; Daniel S. Ortiz

(57) ABSTRACT

An aqueous laundry detergent composition containing a hydroxy mixed ether.

13 Claims, No Drawings

LIQUID DETERGENTS

BACKGROUND OF THE INVENTION

This invention relates generally to liquid detergents and more particularly to preparations containing selected nonionic surfactants and to the use of the nonionic surfactants for the production of liquid detergents.

In recent years, liquid detergents have acquired a firm market share in the field of detergents because they are particularly easy to dose and have advantages over solid detergents, above all in the low-temperature washing of only lightly soiled laundry. By virtue of their inverse solubility behavior, i.e. a solubility which increases with decreasing temperature, nonionic surfactants, such as ethoxylated fatty alcohols for example, are particularly suitable for the production of liquid detergents. However, the disadvantage of nonionic surfactants is that their solubility behavior is not entirely satisfactory and that they tend to form unwanted gel phases; their wetting power is also inadequate. Efforts have been made to overcome this disadvantage by combining the nonionic surfactants with anionic surface-active compounds. Unfortunately, the effect of this is that, in many cases, washing performance at low temperatures—where anionic surfactants are weak—is no longer satisfactory.

Accordingly, the problem addressed by the present invention was primarily to provide new liquid detergents based on nonionic surfactants which would be distinguished by optimized dissolving behavior and improved wetting properties. Another problem addressed by the invention was to provide preparations which would impart a pleasant softness to the treated textiles, even in the absence of cationic surfactants, and—in combination with polymers—to improve the inhibition of dye transfer in the washing of colored fabrics.

DESCRIPTION OF THE INVENTION

The present invention relates to liquid detergents containing hydroxy mixed ethers and to the use of the hydroxy mixed ethers as nonionic surfactants for the production of liquid detergents.

It has surprisingly been found that hydroxy mixed ethers provide the liquid detergents with the desired properties. Dissolving behavior is greatly improved in relation to other nonionic surfactants. In particular, gel phases are no longer formed, instead favorable wetting power is observed and, although not achieving the level of anionic surfactants, is considerably higher than has come to be expected of nonionic surfactants.

Hydroxy Mixed Ethers

Hydroxy mixed ethers (HMEs) are known nonionic surfactants with a nonsymmetrical ether structure and a content of polyalkylene glycols which are obtained, for example, by subjecting olefin epoxides to a ring opening reaction with fatty alcohol polyglycol ethers. Corresponding products and their use in the cleaning of hard surfaces are the subject of, for example, European patent EP 0 693 049 B1 and International patent application WO 94/22800 (Olin) and the documents cited therein. Hydroxy mixed ethers typically correspond to general formula (I):

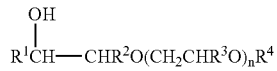

$$R^1\underset{\displaystyle OH}{\underset{|}{C}}H-CHR^2O(CH_2CHR^3O)_nR^4 \quad (I)$$

in which $R^1$ is a linear or branched alkyl group containing 2 to 18 and preferably 10 to 16 carbon atoms, $R^2$ is hydrogen or a linear or branched alkyl group containing 2 to 18 carbon atoms, $R^3$ is hydrogen or methyl, $R^4$ is a linear or branched alkyl and/or alkenyl group containing 1 to 22 and preferably 8 to 18 carbon atoms and n is a number of 1 to 50, preferably 2 to 25 and more preferably 5 to 15 with the proviso that the total number of carbon atoms in the substituents $R^1$ and $R^2$ is at least 6. As the formula suggests, the HMEs may be ring opening products both of internal olefins ($R^2 \neq$hydrogen) or terminal olefins ($R^2$=hydrogen), the latter being preferred for their more favorable performance properties and their easier production. Similarly, the polar part of the molecule may be a polyethylene or a polypropylene chain. Mixed chains of PE and PP units in statistical or block distribution are also suitable. Typical examples are ring opening products of 1,2-hexene epoxide, 2,3-hexene epoxide, 1,2-octene epoxide, 2,3-octene epoxide, 3,4-octene epoxide, 1,2-decene epoxide, 2,3-decene epoxide, 3,4-decene epoxide, 4,5-decene epoxide, 1,2-dodecene epoxide, 2,3-dodecene epoxide, 3,4-dodecene epoxide, 4,5-dodecene epoxide, 5,6-dodecene epoxide, 1,2-tetradecene epoxide, 2,3-tetradecene epoxide, 3,4-tetradecene epoxide, 4,5-tetradecene epoxide, 5,6-tetradecene epoxide, 6,7-tetradecene epoxide, 1,2-hexadecene epoxide, 2,3-hexadecene epoxide, 3,4-hexadecene epoxide, 4,5-hexadecene epoxide, 5,6-hexadecene epoxide, 6,7-hexadecene epoxide, 7,8-hexadecene epoxide, 1,2-octadecene epoxide, 2,3-octadecene epoxide, 3,4-octadecene epoxide, 4,5-octadecene epoxide, 5,6-octadecene epoxide, 6,7-octadecene epoxide, 7,8-octadecene epoxide and 8,9-octadecene epoxide and mixtures thereof with addition products of on average 1 to 50, preferably 2 to 25 and more particularly 5 to 15 moles of ethylene oxide and/or 1 to 10, preferably 2 to 8 and more particularly 3 to 5 moles of propylene oxide onto saturated or unsaturated primary alcohols containing 6 to 22 and preferably 12 to 18 carbon atoms, such as for example caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol and technical mixtures thereof. The hydroxy mixed ethers may make up 1 to 60, preferably 5 to 35 and more particularly 10 to 15% by weight of the liquid detergents according to the invention.

Co-Surfactants

The liquid detergents according to the invention may additionally contain anionic, nonionic, cationic and/or amphoteric or zwitterionic co-surfactants. These co-surfactants may make up 1 to 40, preferably 5 to 35 and more particularly 10 to 15% by weight of the liquid detergents.

Anionic Surfactants

Typical examples of anionic surfactants are soaps, alkyl benzene-sulfonates, alkane sulfonates, olefin sulfonates, alkyl ether sulfonates, glycerol ether sulfonates, (x-methyl ester sulfonates, sulfofatty acids, alkyl sulfates, fatty alcohol ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (especially wheat-based vegetable products) and alkyl (ether) phosphates. If the anionic surfactants contain polyglycol ether chains, the polyglycol ether chains may have a conventional homolog distribution, although they preferably have a narrow homolog distribution. Alkyl benzenesulfonates, alkyl sulfates, soaps, alkanesulfonates, paraffin sulfonates, methyl ester sulfonates and mixtures thereof are preferably used. Preferred alkyl benzenesulfonates correspond to formula (II):

$$R^5—Ph—SO_3X \quad (II)$$

in which $R^5$ is a branched, but preferably linear alkyl group containing 10 to 18 carbon atoms, Ph is a phenyl group and X is an alkali metal and/or alkaline earth metal, ammonium, alkylammonium, alkanolammonium or glucammonium. Of these alkyl benzenesulfonates, dodecyl benzenesulfonates, tetradecyl benzenesulfonates, hexadecyl benzenesulfonates and technical mixtures thereof in the form of the sodium salts are particularly suitable.

Alkyl and/or alkenyl sulfates, which are also often referred to as fatty alcohol sulfates, are understood to be the sulfation products of primary and/or secondary alcohols which preferably correspond to formula (III):

$$R^6O—SO_3X \quad (III)$$

in which $R^6$ is a linear or branched, aliphatic alkyl and/or alkenyl group containing 6 to 22 and preferably 12 to 18 carbon atoms and X is an alkali metal and/or alkaline earth metal, ammonium, alkylammonium, alkanolammonium or glucammonium. Typical examples of alkyl sulfates which may be used in accordance with the invention are the sulfation products of caproic alcohol, caprylic alcohol, capric alcohol, 2-ethylhexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and the technical mixtures thereof obtained by high-pressure hydrogenation of technical methyl ester fractions or aldehydes from Roelen's oxosynthesis. The sulfation products may advantageously be used in the form of their alkali metal salts, more especially their sodium salts. Alkyl sulfates based on $C_{16/18}$ tallow fatty alcohols or vegetable fatty alcohols with a comparable C-chain distribution in the form of their sodium salts are particularly preferred. In the case of branched primary types, the alcohols are oxoalcohols which are obtainable, for example, by reacting carbon monoxide and hydrogen on α-olefins by the Shop process. Corresponding alcohol mixtures are commercially available under the trade names of Dobanol® or Neodol®. Suitable alcohol mixtures are Dobanol 91®, 23®, 25® and 45®. Another possibility are the oxoalcohols obtained by the standard oxo process of Enichema or Condea in which carbon monoxide and hydrogen are added onto olefins. These alcohol mixtures are a mixture of highly branched alcohols and are commercially available under the name of Lial®. Suitable alcohol mixtures are Lial 91®, 111®, 123®, 125®, 145®.

Soaps are understood to be fatty acid salts corresponding to formula (IV):

$$R^7CO—OX \quad (IV)$$

in which $R^7CO$ is a linear or branched, saturated or unsaturated acyl group containing 6 to 22 and preferably 12 to 18 carbon atoms and X is alkali and/or alkaline earth metal, ammonium, alkylammonium or alkanolammonium. Typical examples are the sodium, potassium, magnesium, ammonium and triethanolammonium salts of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. Cocofatty acid or palm kernel oil fatty acid in the form of their sodium or potassium salts—which, in addition, also possess defoaming properties—are preferably used. In one particularly advantageous embodiment, the anionic surfactant content does not exceed 20% by weight and, more particularly, 10% by weight of the total surfactant content.

Nonionic Surfactants

Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, alk(en)yl oligoglycosides, fatty acid-N-alkyl glucamides, protein hydrolyzates (more particularly wheat-based vegetable products), polyol fatty acid esters, sugar esters, sorbitan esters, polysorbates and amine oxides. If the nonionic surfactants contain polyglycol ether chains, the polyglycol ether chains may have a conventional homolog distribution, although they preferably have a narrow homolog distribution. Fatty alcohol polyglycol ethers, alkoxylated fatty acid lower alkyl esters or alkyl oligoglycosides, which give the treated textiles a soft feel otherwise only obtained by using cationic softeners, are preferably used. Preferred fatty alcohol polyglycol ethers correspond to formula (V):

$$R^8O(CH_2CHR^9O)_{n1}H \quad (V)$$

in which $R^8$ is a linear or branched alkyl and/or alkenyl group containing 6 to 22 and preferably 12 to 18 carbon atoms, $R^9$ is hydrogen or methyl and n1 is a number of 1 to 20. Typical examples are products of the addition of, on average, 1 to 20 and preferably 5 to 10 moles of ethylene and/or propylene oxide onto caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol and technical mixtures thereof. Products of the addition of 3, 5 or 7 moles of ethylene oxide onto technical cocofatty alcohols are particularly preferred.

Suitable alkoxylated fatty acid lower alkyl esters are surfactants corresponding to formula (VI):

$$R^{10}CO—(OCH_2CHR^{11})_{n2}OR^{12} \quad (VI)$$

in which $R^{10}CO$ is a linear or branched, saturated and/or unsaturated acyl group containing 6 to 22 carbon atoms, $R^{11}$ is hydrogen or methyl, $R^{12}$ is a linear or branched alkyl group containing 1 to 4 carbon atoms and n2 is a number of 1 to 20. Typical examples are the formal insertion products of, on average, 1 to 20 and preferably 5 to 10 moles of ethylene and/or propylene oxide into the methyl, ethyl, propyl, isopropyl, butyl and tert.butyl esters of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. The products are normally prepared by insertion of the alkylene oxides into the carbonyl ester bond in the presence of special catalysts, for example calcined hydro-talcite. Reaction products of on average 5 to 10 moles of ethylene oxide into the ester bond of technical cocofatty acid methyl esters are particularly preferred.

Alkyl and alkenyl oligoglycosides, which are also preferred nonionic surfactants, normally correspond to formula (VII):

$$R^{13}O—[G]_p \qquad \text{(VII)}$$

in which $R^{13}$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry. EP 0 301 298 A1 and WO 90/03977 are cited as representative of the extensive literature available on the subject. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (VII) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^{13}$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^{13}$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ cocoalcohol with a DP of 1 to 3 are preferred.

Cationic Surfactants

Typical examples of cationic surfactants are, in particular, tetraalkylammonium compounds such as, for example, dimethyl distearyl ammonium chloride or Hydroxyethyl Hydroxycetyl Dimmonium Chloride (Dehyquart E) and esterquats. Estersquats are, for example, quaternized fatty acid triethanolamine ester salts corresponding to formula (VIII):

$$[R^{14}CO(OCH_2CH_2)_{m1}OCH_2CH_2-\overset{\overset{R^{16}}{|}}{\underset{\underset{CH_2CH_2O(CH_2CH_2O)_{m3}R^{17}}{|}}{N^+}}-CH_2CH_2O-(CH_2CH_2O)_{m2}R^{15}]Y^- \qquad \text{(VIII)}$$

in which $R^{14}CO$ is an acyl group containing 6 to 22 carbon atoms, $R^{15}$ and $R^{16}$ independently of one another represent hydrogen or have the same meaning as $R^{14}CO$, $R^{15}$ is an alkyl group containing 1 to 4 carbon atoms or a $(CH_2CH_2O)_{m4}H$ group, m1, m2 and m3 together stand for 0 or numbers of 1 to 12, m4 is a number of 1 to 12 and Y is halide, alkyl sulfate or alkyl phosphate. Typical examples of esterquats which may be used in accordance with the invention are products based on caproic acid, caprylic acid, capric acid, lauric acid, myristic acid, palmitic acid, isostearic acid, stearic acid, oleic acid, elaidic acid, arachic acid, behenic acid and erucic acid and the technical mixtures thereof obtained for example in the pressure hydrolysis of natural fats and oils. Technical $C_{12/18}$ cocofatty acids and, in particular, partly hydrogenated $C_{16/18}$ tallow or palm oil fatty acids and high-elaidic $C_{16/18}$ fatty acid cuts are preferably used. To produce the quaternized esters, the fatty acids and the triethanolamine may be used in a molar ratio of 1.1:1 to 3:1. With the performance properties of the esterquats in mind, a ratio of 1.2:1 to 2.2:1 and preferably 1.5:1 to 1.9:1 has proved to be particularly advantageous. The preferred esterquats are technical mixtures of mono-, di- and triesters with an average degree of esterification of 1.5 to 1.9 and are derived from technical $C_{16/18}$ tallow or palm oil fatty acid (iodine value 0 to 40). In performance terms, quaternized fatty acid triethanolamine ester salts corresponding to formula (VIII), in which $R^{14}CO$ is an acyl group containing 16 to 18 carbon atoms, $R^{15}$ has the same meaning as $R^{15}CO$, $R^{16}$ is hydrogen, $R^{17}$ is a methyl group, m1, m2 and m3 stand for 0 and Y stands for methyl sulfate, have proved to be particularly advantageous.

Other suitable esterquats besides the quaternized fatty acid triethanolamine ester salts are quaternized ester salts of fatty acids with diethanolalkyamines corresponding to formula (IX):

$$[R^{18}CO-(OCH_2CH_2)_{m5}OCH_2CH_2-\overset{\overset{R^{20}}{|}}{\underset{\underset{R^{21}}{|}}{N^+}}-CH_2CH_2O-(CH_2CH_2O)_{m6}R^{19}]Y^- \qquad \text{(IX)}$$

in which $R^{18}CO$ is an acyl group containing 6 to 22 carbon atoms, $R^{19}$ is hydrogen or has the same meaning as $R^{18}CO$, $R^{20}$ and $R^{21}$ independently of one another are alkyl groups containing 1 to 4 carbon atoms, m5 and m6 together stand for 0 or numbers of 1 to 12 and Y stands for halide, alkyl sulfate or alkyl phosphate.

Finally, another group of suitable esterquats are the quaternized ester salts of fatty acids with 1,2-dihydroxypropyl dialkylamines corresponding to formula (X):

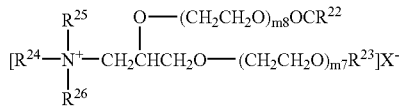

(X)

in which $R^{22}CO$ is an acyl group containing 6 to 22 carbon atoms, $R^{23}$ is hydrogen or has the same meaning as $R^{22}CO$, $R^{24}$, $R^{25}$ and $R^{26}$ independently of one another are alkyl groups containing 1 to 4 carbon atoms, m7 and m8 together stand for 0 or numbers of 1 to 12 and X stands for halide, alkyl sulfate or alkyl phosphate.

Finally, other suitable esterquats are substances in which the ester bond is replaced by an amide bond and which—preferably based on diethylenetriamine—correspond to formula (XI):

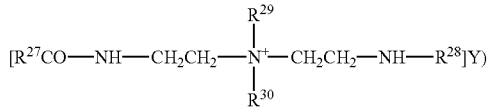

(XI)

in which $R^{27}CO$ is an acyl group containing 6 to 22 carbon atoms, $R^{28}$ is hydrogen or has the same meaning as $R^{27}CO$, $R^{29}$ and $R^{30}$ independently of one another are alkyl groups containing 1 to 4 carbon atoms and Y is halide, alkyl sulfate or alkyl phosphate. Amide esterquats such as these are commercially obtainable, for example, under the name of Incroquat® (Croda).

Amphoteric or Zwitterionic Surfactants

Examples of amphoteric or zwitterionic surfactants are alkyl betaines, alkyl amidobetaines, aminopropionates, aminoglycinates, imidazolinium betaines and sulfobetaines. Examples of suitable alkyl betaines are the carboxyalkylation products of secondary and, in particular, tertiary amines corresponding to formula (XII):

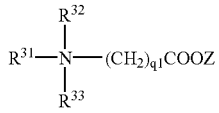

(XII)

in which $R^{31}$ represents alkyl and/or alkenyl groups containing 6 to 22 carbon atoms, $R^{32}$ represents hydrogen or alkyl groups containing 1 to 4 carbon atoms, $R^{33}$ represents alkyl groups containing 1 to 4 carbon atoms, q1 is a number of 1 to 6 and Z is an alkali metal and/or alkaline earth metal or ammonium. Typical examples are the carboxymethylation products of hexylmethyl amine, hexyldimethyl amine, octyldimethyl amine, decyldimethyl amine, dodecylmethyl amine, dodecyldimethyl amine, dodecylethylmethyl amine, $C_{12/14}$ cocoalkyldimethyl amine, myristyldimethyl amine, cetyldimethyl amine, stearyldimethyl amine, stearylethylmethyl amine, oleyldimethyl amine, $C_{16/18}$ tallow alkyldimethyl amine and technical mixtures thereof.

Also suitable are carboxyalkylation products of amidoamines corresponding to formula (XIII):

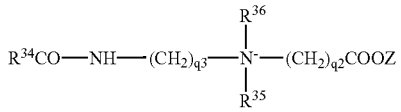

(XIII)

in which $R^{34}CO$ is an aliphatic acyl group containing 6 to 22 carbon atoms and 0 or 1 to 3 double bonds, $R^{35}$ is hydrogen or represents alkyl groups containing 1 to 4 carbon atoms, $R^{36}$ represents alkyl groups containing 1 to 4 carbon atoms, q2 is a number of 1 to 6, q3 is a number of 1 to 3 and Z is again an alkali metal and/or alkaline earth metal or ammonium. Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethylaminoethyl amine, N,N-dimethylaminopropyl amine, N,N-diethylaminoethyl amine and N,N-diethylaminopropyl amine which are condensed with sodium chloroacetate. A condensation product of $C_{8/18}$-cocofatty acid-N, N-dimethylaminopropyl amide with sodium chloroacetate is preferably used.

Imidazolinium betaines may also be used. These compounds are also known compounds which may be obtained, for example, by cyclizing condensation of 1 or 2 moles of fatty acid with polyfunctional amines such as, for example, aminoethyl ethanolamine, (AEEA) or diethylenetriamine. The corresponding carboxyalkylation products are mixtures of different open-chain betaines. Typical examples are condensation products of the fatty acids mentioned above with AEEA, preferably imidazolines based on lauric acid or—again—$C_{12/14}$ cocofatty acid which are subsequently beta-inized with sodium chloroacetate.

Liquid Detergents

The preparations according to the invention may of course also contain other auxiliaries and additives typical of liquid detergents such as, for example, builders, polymers, bleaching agents, bleach activators, enzymes, enzyme stabilizers, redeposition inhibitors, optical brighteners, hydrotropes, perfumes, electrolyte salts and the like in quantities of 1 to 25% by weight, preferably 5 to 20% by weight and more particularly 5 to 15% by weight. The water content of the preparations may be in the range from 25 to 75% by weight and is preferably in the range from 30 to 50% by weight. Liquid detergents in this context are both heavy-duty detergents and special-purpose detergents, including liquid detergents for delicates and colors.

Builders

Useful organic builders suitable as co-builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof. The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard.

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 may be used. A preferred dextrin is described in British patent application 9419091 A1. The oxidized derivatives of such dextrins are their reaction products with oxidizing agents which are capable of oxidizing at least one alcohol function of the saccharide ring to the carboxylic acid function. Dextrins thus oxidized and processes for their production are known, for example, from European patent applications EP 0 232 202 A1, EP 0 427 349 A1, EP 0 472 042 A1 and EP 0 542 496 A1 and from International patent applications WO 92/18542, WO 93/08251, WO 93/16110, WO 94/28030, WO 95/07303, WO 95/12619 and WO 95/20608. An oxidized oligosaccharide corresponding to German patent application DE 196 00 018 A1 is also suitable. A product oxidized at $C_6$ of the saccharide ring can be particularly advantageous.

Other suitable co-builders are oxydisuccinates and other derivatives of disuccinates, preferably ethylenediamine disuccinate. The glycerol disuccinates and glycerol trisuccinates described, for example, in U.S. Pat. No. 4,524,009, in U.S. Pat. No. 4,639,325, in European patent application EP 0 150 930 A1 and in Japanese patent application JP 93/339896 are also particularly preferred in this connection. The quantities used in zeolite-containing and/or silicate-containing formulations are from 3 to 15% by weight. Other useful organic co-builders are, for example, acetylated hydroxycarboxylic acids and salts thereof which may optionally be present in lactone form and which contain at least 4 carbon atoms, at least one hydroxy group and at most two acid groups. Co-builders such as these are described, for example, in International patent application WO 95/20029.

Suitable polymeric polycarboxylates are, for example, the sodium salts of polyacrylic acid or polymethacrylic acid, for example those with a relative molecular weight of 800 to 150,000 (based on acid and measured against polystyrenesulfonic acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000 (as measured against polystyrenesulfonic acid). The (co)polymeric polycarboxylates may be used either as powders or as aqueous solutions, 20 to 55% by weight aqueous solutions being preferred. Granular polymers are generally added to basic granules of one or more types in a subsequent step. Also particularly preferred are biodegradable polymers of more than two different monomer units, for example those which contain salts of acrylic acid and maleic acid and vinyl alcohol or vinyl alcohol derivatives as monomers in accordance with DE 43 00 772 A1 or salts of acrylic acid and 2-alkylallyl sulfonic acid and sugar derivatives as monomers in accordance with DE 42 21 381 C2. Other preferred copolymers are those described in German patent applications DE 43 03 320 A1 and DE 44 17 734 A1 which preferably contain acrolein and acrylic acid/acrylic acid salts or acrolein and vinyl acetate as monomers. Other preferred builders are polymeric aminodicarboxylic acids, salts and precursors thereof. Polyaspartic acids and salts and derivatives thereof are particularly preferred.

Other suitable builders are polyacetals which may be obtained by reaction of dialdehydes with polyol carboxylic acids containing 5 to 7 carbon atoms and at least three hydroxyl groups, for example as described in European patent application EP 0 280 223 A1. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Oil- and Fat-Dissolving Components

In addition, the compositions may contain components with a positive effect on the removability of oil and fats from textiles by washing. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Bleaching Agents and Bleach Acticvators

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecanedioic acid. The content of peroxy bleaching agents in the compositions is preferably 5 to 35% by weight and more preferably up to 30% by weight, perborate monohydrate or percarbonate advantageously being used.

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso- NOBS), carboxylic anhydrides, more particularly phthalic anhydride, acylated polyhydric alcohols, more particularly triacetin, ethylene glycol diacetate, 2,5-diacetoxy-2,5-dihydrofuran and the enol esters known from German patent applications DE 196 16 693 A1 and DE 196 16 767 A1, acetylated sorbitol and mannitol and the mixtures thereof (SORMAN) described in European patent application EP 0 525 239 A1, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO 94/27970, WO 94/28102, WO 94/28103, WO 95/00626, WO 95/14759 and WO 95/17498. The substituted hydrophilic acyl acetals known from German patent application DE 196 16 769 A1 and the acyl lactams described in German patent application DE 196 16 770 and in International patent application WO 95/14075 are also preferably used. The combinations of conventional bleach activators known from German patent application DE 44 43 177 A1 may also be used. Bleach activators such as these are present in the usual quantities, preferably in quantities of 1% by weight to 10% by weight and more preferably in quantities of 2% by weight to 8% by weight, based on the composition as a whole. In addition to or instead of the conventional bleach activators mentioned above, the sulfonimines known from European patents EP 0 446 982 B1 and EP 0 453 003 B1 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 195 29 905 A1 and the N-analog compounds thereof known from German patent application DE 196 20 267 A1, the manganese-, iron-, cobalt-, ruthenium- or molybdenum-carbonyl complexes known from German patent application DE 195 36 082 A1, the manganese, iron, cobalt, ruthenium, molybdenum, titanium, vanadium and copper complexes with nitrogen-containing tripod ligands described in German patent application DE 196 05 688 A1, the cobalt-, iron-, copper- and ruthenium-ammine complexes known from German patent application DE 196 20 411 A1, the manganese, copper and cobalt complexes described in German patent application DE 44 16 438 A1, the cobalt complexes described in European patent application EP 0 272 030 A1, the manganese complexes known from European patent application EP 0 693 550 A1, the manganese, iron, cobalt and copper complexes known from European patent EP 0 392 592 A1 and/or the manganese complexes described in European patent EP 0 443 651 B1 or in European patent applications EP 0 458 397 A1, EP 0 458 398 A1, EP 0 549 271 A1, EP 0 549 272 A1, EP 0 544 490 A1 and EP 0 544 519 A1. Combinations of bleach activators and transition metal bleach catalysts are known, for example, from German patent application DE 196 13 103 A1 and from international patent application WO 95/27775. Bleach-boosting transition metal complexes, more particularly with the central atoms Mn, Fe, Co. Cu, Mo. V, Ti and/or Ru, are used in typical quantities, preferably in a quantity of up to 1% by weight, more preferably in a quantity of 0.0025% by weight to 0.25% by weight and most preferably in a quantity of 0.01% by weight to 0.1% by weight, based on the composition as a whole.

Enzymes and Enzyme Stabilizers

Suitable enzymes are, in particular, enzymes from the class of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discoloration in the washing process. Cellulases and other glycosyl hydrolases can contribute towards color retention and towards increasing fabric softness by removing pilling and microfibrils. Oxidoreductases may also be used for bleaching and for inhibiting dye transfer. Enzymes obtained from bacterial strains or fungi, such as *Bacillus subtilis, Bacillus licheniformis, Streptomyces griseus* and *Humicola insolens* are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios. The enzymes may be adsorbed to supports and/or encapsulated in shell-forming substances to protect them against premature decomposition. The percentage content of enzymes, enzyme mixtures or enzyme granules may be, for example, about 0.1 to 5% by weight and is preferably from 0.1 to about 2% by weight.

In addition to the monohydric and polyhydric alcohols, the compositions may contain other enzyme stabilizers. For example, 0.5 to 1% by weight of sodium formate may be used. Proteases stabilized with soluble calcium salts and having a calcium content of preferably about 1.2% by weight, based on the enzyme, may also be used. Apart from calcium salts, magnesium salts also serve as stabilizers. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

Redeposition Inhibitors

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the detergent. In color detergents, the use of polyvinyl pyrrolidone or corresponding PVP copolymers has proved to be particularly effective for avoiding dye transfer. Here, the combination with hydroxy mixed ethers as surfactant component has another advantage because dye transfer is inhibited particularly effectively.

Optical Brighteners

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned may also be used. Uniformly white granules are obtained if, in addition to the usual brighteners in the usual quantities, for example between 0.1 and 0.5% by weight and preferably between 0.1 and 0.3% by weight, the compositions also contain small quantities, for example $10^{-6}$ to $10^{-3}$% by weight and preferably around $10^{-5}$% by weight, of a blue dye. A particularly preferred dye is Tinolux® (a product of Ciba-Geigy).

Polymers

Suitable soil repellents are polymers which preferably contain ethylene terephthalate and/or polyethylene glycol terephthalate groups, the molar ratio of ethylene terephthalate to polyethylene glycol terephthalate being in the range from 50:50 to 90:10. The molecular weight of the linking polyethylene glycol units is more particularly in the range from 750 to 5,000, i.e. the degree of ethoxylation of the polymers containing polyethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000. Examples of commercially available polymers are the products Milease® T (ICI) or Repelotex® SRP 3 (Rhône-Poulenc).

Hydrotropes

In addition, hydrotropes, for example ethanol, isopropyl alcohol or polyols, may be used to improve flow behavior. Suitable polyols preferably contain 2 to 15 carbon atoms and at least two hydroxyl groups. The polyols may contain other functional groups, more particularly amino groups, or may be modified with nitrogen. Typical examples are

- glycerol;
- alkylene glycols such as, for example, ethylene glycol, diethylene glycol, propylene glycol, butylene glycol, hexylene glycol and polyethylene glycols with an average molecular weight of 100 to 1000 dalton;
- technical oligoglycerol mixtures with a degree of self-condensation of 1.5 to 10 such as, for example, technical diglycerol mixtures with a diglycerol content of 40 to 50% by weight;
- methylol compounds such as, in particular, trimethylol ethane, trimethylol propane, trimethylol butane, pentaerythritol and dipentaerythritol;
- lower alkyl glucosides, particularly those containing 1 to 8 carbon atoms in the alkyl group, for example methyl and butyl glucoside;
- sugar alcohols containing 5 to 12 carbon atoms, for example sorbitol or mannitol,
- sugars containing 5 to 12 carbon atoms, for example glucose or sucrose;
- aminosugars, for example glucamine
- dialcoholamines, such as diethanolamine or 2-aminopropane-1,3-diol.

Perfumes

Suitable perfume oils or fragrances include individual fragrance compounds, for example synthetic products of the ester, ether, aldehyde, ketone, alcohol and hydrocarbon type. Fragrance compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various fragrances which together produce an attractive fragrance note are preferably used. Perfume oils such as these may also contain natural fragrance mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil. The fragrances may be directly incorporated in the compositions according to the invention, although it can also be of advantage to apply the fragrances to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries.

Inorganic Salts

Other suitable ingredients of the detergents are water-soluble inorganic salts, such as bicarbonates, carbonates, citrates, amorphous silicates, normal waterglasses without prominent builder properties or mixtures thereof. One particular embodiment is characterized by the use of alkali metal carbonate and/or amorphous alkali metal silicate, above all sodium silicate with a molar $Na_2O:SiO_2$ ratio of 1:1 to 1:4.5 and preferably in the range from 1:2 to 1:3.5. The sodium carbonate content of the final preparations is preferably up to 40% by weight and advantageously between 2 and 35% by weight. The content of sodium silicate (without particular builder properties) in the detergents is generally up to 10% by weight and preferably between 1 and 8% by weight.

EXAMPLES

Washing performance was determined in a Miele W 918 washing machine at 30° C. (water hardness 16° d) with 3.5 kg of standard washing and a detergent dose of 70 g. The evaluation was made photometrically on a washable mixed soil (WS) and a cosmetic mixed soil (CS) against a white standard (=100% reflectance). Dissolving behavior was determined indirectly via the measurement of viscosity on dilution of the preparations with water. It was assumed that a high viscosity over a broad dilution range is synonymous with slow dissolution during the wash cycle. To this end, quantities of 50 ml of liquid detergent were diluted in stages with 5, 10 and 25 ml water with continuous stirring and the Brookfield viscosity was determined (20° C., 10 r.p.m.). The composition of the detergents and the performance results are set out in Table 1. Examples 1 to 8 correspond to the invention, Examples C1 to C6 are intended for comparison.

TABLE 1

Washing performance and viscosity (quantities in % by weight)

| Composition | C1 | 1 | 2 | C2 | 3 | C3 | 4 |
|---|---|---|---|---|---|---|---|
| $C_{12-18}$ coconut alcohol + 7 EO | 25 | 17 | 12 | — | — | — | — |
| $C_{11-13}$ oxoalcohol + 7 EO | — | — | — | 20 | 12 | 20 | 7 |
| HME I[1)] | — | 8 | — | — | — | — | 13 |
| HME II[2)] | — | — | 13 | — | 8 | — | — |
| Coconut alkyl oligo-glucoside | 4 | 4 | 4 | — | — | — | — |
| $C_{12-18}$ coconut fatty acid Na salt | 14 | 14 | 14 | 14 | 14 | 14 | 14 |
| Dodecyl benzene-sulfonate Na salt | 4 | 4 | 4 | — | — | 10 | 10 |
| $C_{11-13}$ paraffin sulfonate Na salt | — | — | — | 11 | 11 | — | — |
| Sodium citrate | 5 | 5 | 5 | 5 | 5 | 5 | 5 |
| Ethanol | 5 | 5 | 5 | 5 | 5 | 5 | 5 |
| Propylene glycol | 4 | 4 | 4 | 4 | 4 | 4 | 4 |
| Water | | | to 100 | | | | |
| Washing performance [% reflectance] | | | | | | | |
| Heavy-duty wash [WS] | 65 | 70 | 67 | 62 | 66 | 66 | 68 |
| Heavy-duty wash (CS) | 70 | 75 | 74 | 68 | 75 | 70 | 77 |
| Viscosity [mPas] | | | | | | | |
| 5 ml | 500 | 400 | 300 | | | | |
| 10 ml | 2000 | 1200 | 1800 | | | | |
| 25 ml | >2000 | 900 | 1000 | | | | |

TABLE 1-continued

Washing performance and viscosity (quantities in % by weight)

| Composition | C4 | 5 | 6 | C5 | 7 | C6 | 8 |
|---|---|---|---|---|---|---|---|
| $C_{12-18}$ coconut alcohol + 7 EO | 18 | 16 | 14 | — | — | 14 | — |
| $C_{11-13}$ oxoalcohol + 7 EO | — | — | — | 18 | 14 | — | — |
| HME I[1)] | — | 2 | 2 | — | 4 | — | 14 |
| HME II[2)] | — | — | 2 | — | — | — | — |
| Coconut alkyl oligo-glucoside | — | — | — | — | — | 4 | 4 |
| $C_{12-18}$ coconut fatty acid Na salt | 4 | 4 | 4 | 4 | 4 | 4 | 4 |
| Dodecyl benzene-sulfonate Na salt | 2 | 2 | 2 | 4 | 4 | 4 | 4 |
| $C_{12-14}$ coconut alcohol + 2 EO sulfate Na salt | 6 | 6 | 6 | 4 | 4 | 4 | 4 |
| Sodium citrate | 5 | 5 | 5 | 5 | 5 | 5 | 5 |
| Ethanol | 2 | 2 | 2 | 2 | 2 | 2 | 2 |
| Propylene glycol | 4 | 4 | 4 | 4 | 4 | 4 | 4 |
| Water | | | to 100 | | | | |
| Washing performance [% reflectance] | | | | | | | |
| Light-duty wash [WS] | 55 | 63 | 60 | 52 | 55 | 57 | 63 |
| Light-duty wash (CS) | 60 | 67 | 63 | 60 | 65 | 64 | 70 |
| Viscosity [mPas] | | | | | | | |
| 5 ml | | | | | | 400 | 300 |
| 10 ml | | | | | | 1500 | 700 |
| 25 ml | | | | | | 1800 | 500 |

[1)]Reaction product of 1,2-decene epoxide with octanol/decanol + 1 PO + 22 EO

[2)]Reaction product of 1,2-dodecene epoxide with $C_{13/15}$ oxoalcohol + 40 EO

The invention claimed is:

1. A method for improving the cleaning performance of an aqueous, liquid, laundry detergent composition, the detergent composition comprising: water, anionic co-surfactants, auxiliaries and additives, whereby, the cleaning performance is improved by adding to the detergent composition from about 1 to 35% by weight of a hydroxy mixed ether of the formula:

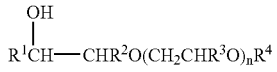

(I)

wherein $R^1$ is a linear or branched alkyl group containing 2 to 18 carbon atoms, $R^2$ is hydrogen or a linear or branched alkyl group containing from 2 to 18 carbon atoms, $R^3$ is hydrogen or methyl, $R^4$ is a linear or branched alkyl or alkenyl group containing from 1 to 22 carbon atoms, n is a number from 1 to 50 and, wherein, the total number of carbon atoms in $R^1$ and $R^2$ is at least 6 and, wherein, the percent by weight is based on the total weight of the detergent composition and the hydroxy mixed ether.

2. The method of claim 1 wherein the hydroxy mixed ether comprises a compound of the formula:

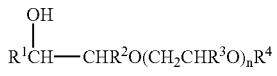

(I)

wherein $R^1$ is a linear or branched alkyl group containing from about 2 to 18 carbon atoms, $R^2$ is hydrogen or a linear or branched alkyl group containing from about 2 to 18 carbon atoms, $R^3$ is hydrogen or methyl, $R^4$ is a linear or branched alkyl or alkenyl group containing from 6 to 18 carbon atoms and n is a number from 2 to 25, and wherein the total number of carbon atoms in the substituents $R^1$ and $R^2$ is at least 6.

3. The method of claim 1 wherein the hydroxy mixed ether is present in the composition in an amount of from 5 to 15% by weight, based on the weight of the composition.

4. The method of claim 1 wherein the hydroxy mixed ether is present in the composition in an amount of from about 10 to 15% by weight, based on the weight of the composition.

5. The method of claim 1, wherein the composition further comprises at least one co-surfactant selected from the group consisting of nonionic surfactants, cationic surfactants, amphoteric surfactants, and zwitterionic surfactants.

6. The method of claim 5 wherein the co-surfactant comprises nonlonic surfactants and anionic surfactants in an amount of from about 1 to 40% by combined weight, based on the weight of the composition.

7. The method of claim 1 wherein the liquid detergent composition comprises: at least one member selected from the group consisting of builders, polymers, redeposition inhibitors, optical brighteners, hyd rotropes, perfumes and bleaching agents.

8. The method of claim 1 wherein the hydroxy mixed ether comprises a hydroxy mixed ether of the formula:

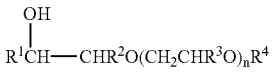

(I)

wherein $R^1$ is a linear or branched alkyl group containing from 10 to 16 carbon atoms, $R^2$ is hydrogen or a linear or branched alkyl group containing from 2 to 18 carbon atoms, $R^3$ is hydrogen or methyl, $R^4$ is a linear or branched alkyl or alkenyl group containing from 8 to 18 carbon atoms and n is a number from 1 to 50, and wherein the total number of carbon atoms in the substituents $R^1$ and $R^2$ is at least 12.

9. The method of claim 1 wherein the hydroxy mixed ether (I) comprises from 1–10 propoxy groups.

10. The method of claim 9 wherein the hydroxy mixed ether is present in the composition in an amount of from 1 to 15% by weight based on the weight of the composition.

11. The method of claim 7 wherein the composition further comprises at least one co-surtactant component selected from the group consisting of nonionic surfactants, cationic surfactants, amphoteric surfactants, and zwitterionic surfactants.

12. The method of claim 11 wherein the co-surfactant component is present in the composition in an amount of from about 1 to 40% by weight, based on the weight of the composition.

13. A process for cleaning textiles comprising contacting the textiles with an aqueous, liquid, laundry detergent composition containing: a hydroxy mixed ether of the formula:

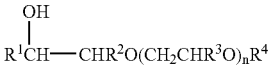

(I)

wherein $R^1$ is a linear or branched alkyl group containing from 2 to 18 carbon atoms, $R^2$ is hydrogen or a linear or branched alkyl group containing from 2 to 18 carbon atoms, $R^3$ is hydrogen or methyl, $R^4$ is a linear or branched alkyl or alkenyl group containing from 1 to 22 carbon atoms and n is a number from 1 to 50, and wherein the total number of carbon atoms in the substituents $R^1$ and $R^2$ is at least 6, an anionic co-surfactant, additives and auxiliaries.

* * * * *